United States Patent [19]

Kleefeldt et al.

[11] Patent Number: 4,932,690

[45] Date of Patent: Jun. 12, 1990

[54] POWER LATCH ASSEMBLY FOR CENTRAL LOCK SYSTEM

[75] Inventors: Frank Kleefeldt; Rolf Schüler, both of Heiligenhaus, Fed. Rep. of Germany

[73] Assignee: Kiekert GmbH & Co. Kommanditgesellschaft, Heiligenhaus, Fed. Rep. of Germany

[21] Appl. No.: 343,583

[22] Filed: Apr. 25, 1989

[30] Foreign Application Priority Data

Jul. 12, 1988 [DE] Fed. Rep. of Germany ..... 3823502

[51] Int. Cl.[5] ..... F05B 47/00

[52] U.S. Cl. ..... 292/337; 292/336.3; 292/201

[58] Field of Search ..... 292/144, 201, 337, 216, 292/336.3, DIG. 23, DIG. 3; 70/264, 275, 277, 280

[56] References Cited

U.S. PATENT DOCUMENTS

| | | | |
|---|---|---|---|
| 4,135,377 | 1/1979 | Kleefeldt et al. | 292/201 X |
| 4,257,637 | 3/1981 | Kleefeldt | 292/201 X |
| 4,272,112 | 6/1981 | Schlick et al. | 292/201 |
| 4,342,209 | 8/1982 | Kleefledt | 70/264 |
| 4,364,249 | 12/1982 | Kleefeldt | 292/201 X |
| 4,601,500 | 7/1986 | Bernard | 292/201 |
| 4,735,447 | 4/1988 | Kleefeldt | 292/201 X |
| 4,821,521 | 4/1989 | Schüler | 292/216 |
| 4,824,152 | 4/1987 | Jeavons | 292/216 |

*Primary Examiner*—Eric K. Nicholson

*Attorney, Agent, or Firm*—Herbert Dubno; Andrew Wilford

[57] ABSTRACT

A standard power-type motor-vehicle latch assembly comprises a door latch having an actuating lever displaceable between a position in which a respective door of the vehicle is locked and a position in which the respective door is unlocked, a locking knob connected to the lever and accessible from inside the vehicle to displace the lever between its positions, a power actuator having a housing, a motor in the housing, and an actuating element movable by the motor between a pair of positions, and a linkage interconnecting the element with the lever for operation of the latter by the former. The actuator housing is mounted directly on the door latch and the level is integrally formed with an actuating arm having an end projecting from the latch into the actuator housing and forming part of the linkage. The element is formed with a seat receiving the arm end and also forming part of the linkage.

6 Claims, 2 Drawing Sheets

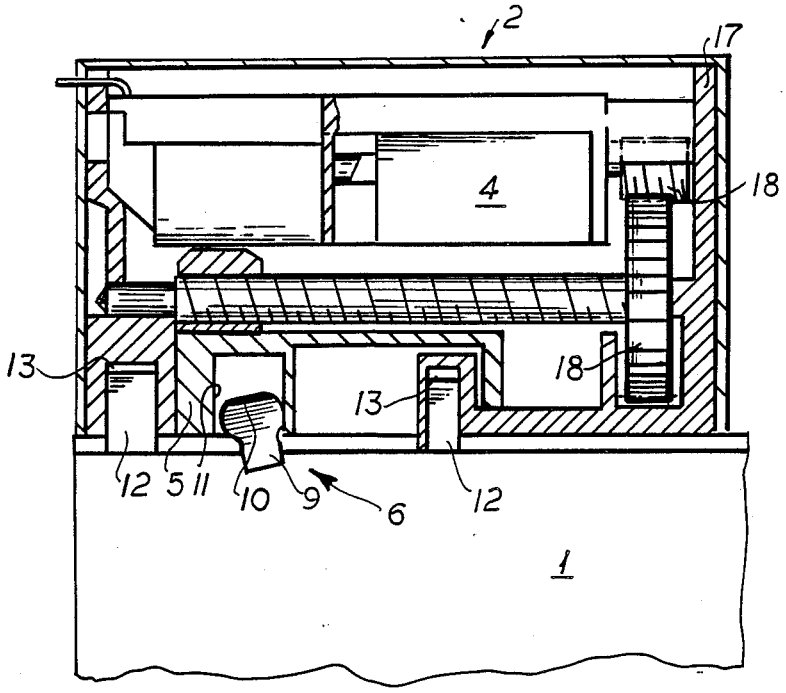
FIG.2
FIG.3
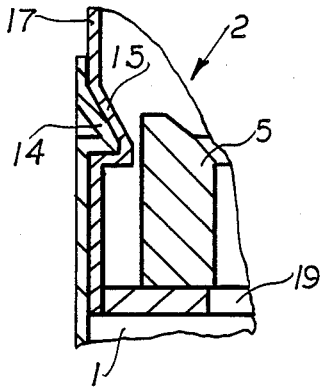

POWER LATCH ASSEMBLY FOR CENTRAL LOCK SYSTEM

FIELD OF THE INVENTION

The present invention relates to a latch assembly. More particularly this invention concerns such an assembly used on a central motor-vehicle lock system.

BACKGROUND OF THE INVENTION

A standard central motor-vehicle lock system has a plurality of door latches on the individual doors, hatches, trunk lids, and the like that are each operable by a respective power actuator and also by a manual mechanism. The power actuator can include a hydraulic, pneumatic, or electric motor, and the manual mechanism is almost always a lever linkage.

In a standard system such as described in my U.S. Pat. No. 4,342,209 each door latch has a locking level displaceable between a pair of end positions corresponding to locked and unlocked conditions of the respective door. This lever is connected on the one side via a rod to the inside unlocking button in the case of a door and on the other side via another such rod to the power actuator which is mounted in the door at some remove from the latch. Thus either the knob or the actuator can be operated to lock or unlock the door.

It has become common to provide a standard central locking system with a so-called antitheft feature. When set in the antitheft mode it is impossible to unlock the vehicle doors even by manual actuation of the inside knobs. Thus a person who breaks a window or otherwise gains forcible entry to the vehicle cannot open its doors.

Such a system is typically incorporated into the above-described power actuator by either driving the element that acts via the rod on the unlocking lever with such a large mechanical advantage that forcible reverse-driving of this motor is impossible, or by providing a system which positively freezes this actuating element. Either way action on the inside knob will be countered by the actuator via the rod connecting it to the latch locking lever.

A weakness of such a system is that an extreme force exerted on the inside knob, for instance by prying on it, can bend or break the rod connecting the locking lever to the actuator. This problem is particularly great when the knob must be pulled away from the latch to unlock the door, as the amount of force such a rod can withstand in tension is considerably greater than the forces that the rest of the elements can resist. The only way to make the system secure against such attack is to dimension all the parts the entire connection between the actuator and the locking lever so they are very strong. This augments the weight and cost of these elements considerably.

OBJECTS OF THE INVENTION

It is therefore an object of the present invention to provide an improved power-type central lock system.

Another object is the provision of such an improved power-type central lock system which overcomes the above-given disadvantages, that is which need not be overbuilt to withstand the above-mentioned type of attack.

SUMMARY OF THE INVENTION

The instant invention is used in a standard power-type motor-vehicle latch assembly comprising a door latch having an actuating lever displaceable between a position in which a respective door of the vehicle is locked and a position in which the respective door is unlocked, a locking knob connected to the lever and accessible from inside the vehicle to displace the lever between its positions, a power actuator having a housing, a motor in the housing, and an actuating element movable by the motor between a pair of positions, and a linkage interconnecting the element with the lever for operation of the latter by the former. According to this invention the actuator housing is mounted directly on the door latch and the lever is integrally formed with an actuating arm having an end projecting from the latch into the actuator housing and forming part of the linkage. The element is formed with a seat receiving the arm end and also forming part of the linkage.

With this system therefore the second rod connecting the actuator to the locking lever is eliminated and replaced with a much more direct connection. This direct connection is much stronger than the rod used according to this invention to connect a second arm of the locking lever to the knob inside the door, so that this knob cannot be forced to overcome the connection between the actuator and the locking lever.

According to this invention the latch is provided with at least two spaced pins projecting from the latch in a direction transverse to the displacement direction of the element and the actuator housing is formed with holes snugly receiving the pins. In addition releasable holding members engage between the latch and the actuator housing for holding same releasable together. The actuator housing is formed with a slot through which the arm end projects and at which the element seat is exposed and the pins flank the slot. Furthermore the holding members are elastically deformable fingers projecting from the latch, embracing the actuator housing, and having ends with barb formations which engage in respective sawtooth pockets on the latch housing. Thus the actuator unit can be mounted on and removed from the latch without the use of tools.

According to another feature of this invention the element is a slide displaceable in a straight line. The motor is a reversible electric motor and the actuator includes a worm linkage connecting the motor to the element.

DESCRIPTION OF THE DRAWING

The above and other objects, features, and advantages will become more readily apparent from the following, reference being made to the accompanying drawing in which:

FIG. 2 is a large-scale sectional view of the upper portion of the structure of FIG. 1; and FIG. 3 is a section taken along line III—III of FIG. 1 of a detail of the latch assembly.

SPECIFIC DESCRIPTION

Figure 1:
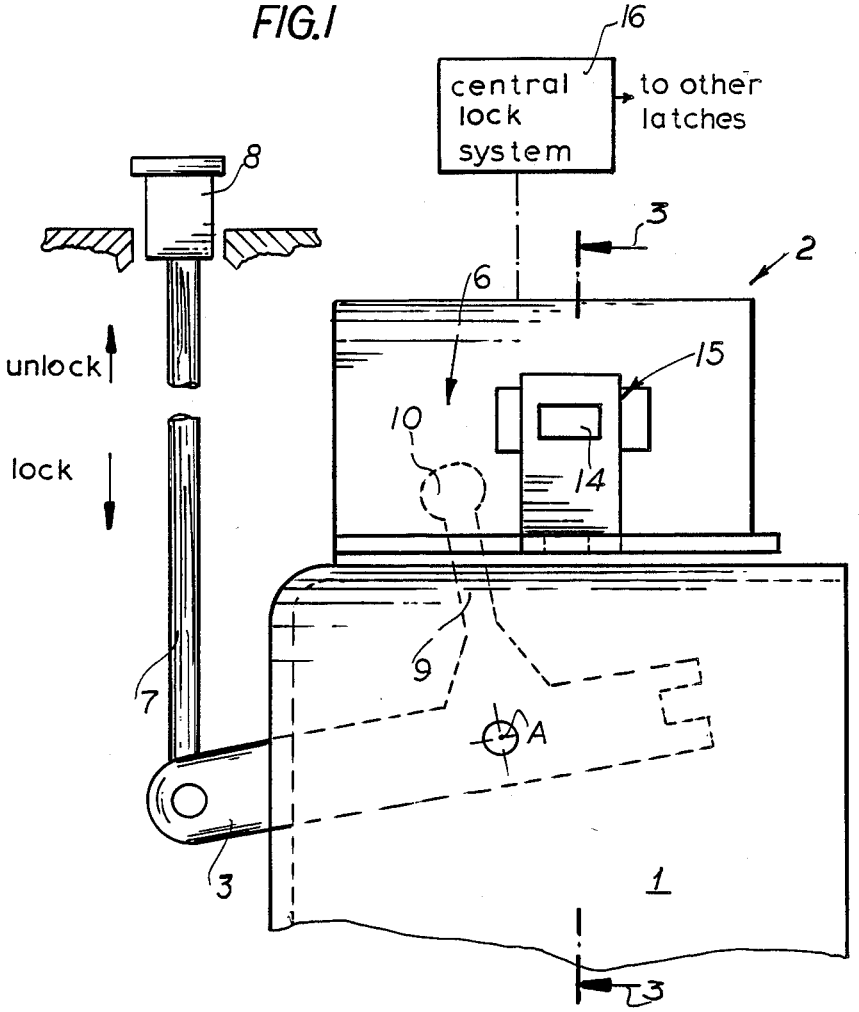
FIG. 1 is a partly schematic side view of the latch assembly according to this invention.

As seen in FIG. 1 a motor-vehicle door latch shown generally at 1 can be operated by an actuator 2 that is powered along with the other door and trunk latches from a remote central lock system 16 of the type generally described in my above-cited patent. The latch 1 has, in addition to the locking fork and standard inside-door and outside-door actuating mechanisms that are not relevant to the instant invention, a locking lever 3 which in the illustrated embodiment is pivoted clockwise about its axis A to unlock the door and counterclockwise to lock it. A standard inside button 8 is connected via a rod 7 to this lever 3 to operate it manually from inside the vehicle.

According to this invention and as best seen in FIGS. 2 and 3 the power actuator 2 has a substantially closed housing 17 provided internally with a reversible electric motor 4 connected through a worm drive 18 of high stepdown ratio to a slide 5 so that rotation of the motor output shaft in one sense moves the slide 5 in one direction and vice versa. The locking lever 3 has a supplementary actuating element 6 constituted by an arm 9 projecting radially from the axis A and having a head 10 that projects through an aperture in the side of the latch 1 and through a slot 19 into the housing 17. The slide 5 can reciprocate above this slot 19 and is formed with an outwardly open seat 11 in which the head 10 is received with slight play. Thus when the slide 5 moves the lever 3 will be acted on directly, and with considerable force. Similarly the high stepdown between the motor 4 and the slide 5 ensures that a force brought to bear on this slide 5 will not be able to reverse drive the motor 4.

The housing 17 is held in position on the housing of the latch 1 by two pins 12 that are fixed on this latch 1 and that project from it, fitting snugly into complementary holes 13 formed at each end of the slot 19. One of the pins 12 is larger than the other to make reverse mounting of the actuator 2 impossible. In addition each side of the housing 17 is formed with a sawtooth pocket 15 into which a complementary tooth 14 of an elastically deformable finger fixed on the latch 1 can fit. Thus mounting of the actuator 2 on the latch 1 is as easy as pushing it down over the pins 12 until the barb teeth 14 snap into their pockets 15. Disassembly requires that these teeth 14 be pulled out of their seats while the actuator 2 is lifted. Both operations require no tools but once the two parts are joined normal operation will not force them apart since the pins 12 are capable of withstanding considerable shear.

We claim:

1. In a power-type motor-vehicle latch assembly comprising a door latch having an actuating lever displaceable between a position in which a respective door of the vehicle is locked and a position in which the respective door is unlocked;

a locking knob connected to the lever and accessible from inside the vehicle to displace the lever between its positions;

a power actuator having a housing, a motor in the housing, and an actuating element movable by the motor between a pair of positions; and a linkage interconnecting the element with the lever for operation of the latter by the former, the improvement wherein:

at least two spaced pins project from the latch in a direction transverse to the displacement direction of the element;

the actuator housing is mounted directly on the door latch and is formed with holes snugly receiving the pins;

the lever is integrally formed with an actuating arm having an end projecting from the latch into the actuator housing and forming part of the linkage;

the element is formed with a seat receiving the arm end and also forming part of the linkage; and means is provided including releasable holding members enagageable between the latch and the actuator housing for holding same releasably together.

2. The improved latch assembly defined in claim 1 wherein the actuator housing is formed with a slot through which the arm end projects and at which the element seat is exposed, the pins flanking the slot.

3. The improved latch assembly defined in claim 1 wherein the holding members are elastically deformable fingers projecting from the latch, embracing the actuator housing, and having ends with barb formations, the actuator housing having respective sawtooth pockets receiving the formations.

4. The improved latch assembly defined in claim 1 wherein the element is a slide displaceable in a straight line.

5. The improved latch assembly defined in claim 4 wherein the motor is a reversible electric motor and the actuator includes a worm linkage connecting the motor to the element.

6. The improved latch assembly defined in claim 1 wherein the lever has a second such arm separate from the first-mentioned arm, the assembly further comprising a rod connecting the second arm to the knob.

* * * * *